US006045425A

United States Patent [19]

Bothra et al.

[11] Patent Number: 6,045,425

[45] Date of Patent: Apr. 4, 2000

[54] PROCESS FOR MANUFACTURING ARRAYS OF FIELD EMISSION TIPS

[75] Inventors: Subras Bothra; Ling Q. Qian, both of San Jose, Calif.

[73] Assignee: VLSI Technology, Inc., San Jose, Calif.

[21] Appl. No.: 08/819,284

[22] Filed: Mar. 18, 1997

[51] Int. Cl.[7] ..... H01J 9/02

[52] U.S. Cl. ..... 445/24; 445/58

[58] Field of Search ..... 445/24, 50, 58

[56] References Cited

U.S. PATENT DOCUMENTS

| | | | |
|---|---|---|---|
| 5,540,958 | 7/1996 | Bothra et al. | 427/535 |
| 5,693,235 | 12/1997 | Liu et al. | 445/24 |
| 5,817,201 | 10/1988 | Greschner et al. | 445/24 X |
| 5,827,099 | 10/1988 | Spindt et al. | 445/24 |

OTHER PUBLICATIONS

Katherine Derbyshire, "Beyond AMLCDs: Field emission displays?", Solid State Technology, Nov. 1994, pp. 55–65.

Nalln Kumar, et al., "Diamond–based field emission flat panel displays", Solid State Technology, May 1995, pp. 71–74.

Peter Singer, "Flat Panel Processing Trends", Semiconductor International, Nov. 1995, p. 90.

*Primary Examiner*—Kenneth J. Ramsey

*Attorney, Agent, or Firm*—Gary S. Williams; Pennie & Edmonds LLP

[57] ABSTRACT

A method for manufacturing arrays of field emission tips, suitable for use in field emission displays (FEDs), begins by depositing a conductive cathode layer over a substrate and then patterning the conductive cathode layer to define a set of cathode structures on which the array of tips are to be formed. A layer of a insulator material is deposited and then a layer of lift-off material is deposited. The lift-off material is capable of being selectively etched with respect to the insulator layer. The insulator material layer and lift-off material layer are patterned to define a set of apertures in which field emission tips are to be formed. Next, tip material is deposited using an unbiased high density plasma chemical vapor deposition (HDPCVD) process to form sharp field emission tips in the apertures. The HDPCVD process also forms a sacrificial layer of islands of tip material on top of the patterned layer of lift-off material. After the formation of the field emission tips, the patterned layer of lift-off material is removed using a wet chemical etchant that also removes sacrificial layer of tip material. A layer of fill material is deposited and planarized so as to fill the apertures in which the tips were formed. A gate layer is then deposited and patterned to form gate structures. A subsequent wet etch removes the fill material surrounding the emitter tips.

10 Claims, 6 Drawing Sheets

PROCESS FOR MANUFACTURING ARRAYS OF FIELD EMISSION TIPS

The present invention relates generally to the manufacture of a class of flat panel display devices known as field emission displays, and particularly to a manufacturing process that uses a lift-off layer for facilitating the manufacturing of arrays of field emission tips.

BACKGROUND OF THE INVENTION

As of the end of 1996, the flat panel displays widely used in portable computers are primarily active matrix liquid crystal displays (AMLCDs). AMLCDs, however, are inherently slow with regard to image update rate, and are manufactured using complex processes that suffer from low yields. An alternate flat panel display technology, field emission displays (FEDs), offers reduced manufacturing process complexity with improved brightness and operating speeds. FEDs are based on arrays of field emission tips. They produce light using colored phosphors in much the same way as conventional cathode ray tubes (CRTs). As a result, FEDs do not need the backlights and filters required by AMLCDs.

In principle, an FED is similar to a conventional CRT. In an FED, electrons are liberated from a cathode and strike a phosphor on a transparent faceplate to produce an image. In contrast to a CRT, which has a single electron source (or sometimes three, one for each primary color), each pixel in an FED has its own electron source, a field emission tip. FIG. 1 shows a cross-section of a small portion of an FED 100. As shown, the FED 100 has a substrate or base plate 102, which may be a semiconductor substrate on which circuitry for driving the display has been formed. A conductive cathode layer 104 is formed on top of the substrate. Above the cathode layer are the emitter tips 106 surrounded by insulator material 108. Next there is a patterned conductive gate layer 110 for controlling the emission of electrons by the emitter tips 106. The cathode layer 104 may be patterned into rows and the gate layer patterned into columns so as to form an addressable matrix of emitter tips. The electrons 114 emitted by the tips travel through an evacuated region 112 and strike phosphors (not shown) on the inside surface of a faceplate 116.

The prior art FEDs use microtip emitters made, alternately, from metal, silicon or diamond.

In the prior art, metal microtips have been fabricated using metal evaporation. The evaporation process has limited uniformity over large areas and therefore the use of evaporation has been discontinued in current state-of-the-art CMOS process technologies. The thickness control of the deposited metal is very poor using evaporation. Thus, control of the tip shape is very difficult using evaporation.

In the prior art silicon microtip technology, wet etching of silicon has been used to define the tips. The use of wet etching results in limited resolution capability. The present invention, described below, overcomes these limitations and allows the tip fabrication process to be integrated with advanced CMOS process technologies. The present invention provides significantly improved tip resolution, allowing the formation of a higher density of tips over a given substrate area. Also, the tip radius is reduced significantly, improving the performance of the tips.

It is an object of the present invention to provide an efficient process for producing arrays of field emission tips suitable for use in field emission display devices.

SUMMARY OF THE INVENTION

The present invention provides a method for manufacturing arrays of field emission tips suitable for use in field emission displays (FEDs). The manufacturing process begins by depositing a conductive cathode layer over a substrate and then patterning the conductive cathode layer to define a set of cathode structures on which the array of tips are to be formed. Next, a layer of a insulator material is deposited and then a layer of lift-off material is deposited. The lift-off material is capable of being selectively etched with respect to the insulator layer. The insulator material layer and lift-off material layer are patterned to define a set of apertures in which field emission tips are to be formed. Next, tip material is deposited using an unbiased high density plasma chemical vapor deposition (HDPCVD) process to form sharp field emission tips in the apertures. The HDPCVD process also forms a sacrificial layer of islands of tip material on top of the patterned layer of lift-off material. The islands at least partially overhang the apertures, forming a shadow mask during the deposition process which gives rise to a sharp tip profile.

After the formation of the field emission tips, the patterned layer of lift-off material is removed using a wet chemical etchant that selectively etches the lift-off material at a much higher rate than the tip material and the insulator material. The removing step also removes the sacrificial layer of tip material because the sacrificial layer is lifted off the substrate when the underlying layer of lift-off material is etched away.

After the layer of lift-off material has been removed, a layer of fill material such as spin on glass (SOG) is deposited and planarized so as to fill the apertures in which the tips were formed. A gate layer is then deposited and patterned to form gate structures. Additional notches around the tips may be formed in the gate layer so as to facilitate a subsequent wet etch that is used to remove the fill material surrounding the emitter tips.

BRIEF DESCRIPTION OF THE DRAWINGS

Additional objects and features of the invention will be more readily apparent from the following detailed description and appended claims when taken in conjunction with the drawings, in which:

FIGS. 3A, 3B, 3C, 3D, 3E, 3F-1, 3F-2, 3G, 3H, 3I and 3J depict a sequence of cross section, perspective and plan views of a substrate and overlying layers during manufacture of an array of field emission tips.

DESCRIPTION OF THE PREFERRED EMBODIMENTS

Referring to FIGS. 2 and 3A–3J, a preferred embodiment of the field emission tip array fabrication process of the present invention is as follows. The process begins by providing (step 200) a substrate 230. The substrate 230 may be formed from silicon or other semiconductor material, a dielectric material, a semiconductor material covered by a dielectric material or vice versa. Further, prior to performing the tip array formation steps discussed in this document, one or more layers 232 of circuit formation materials may be formed on the substrate 230 (step 202) so as to manufacture circuitry for driving the array of field emission tips.

Figure 1:
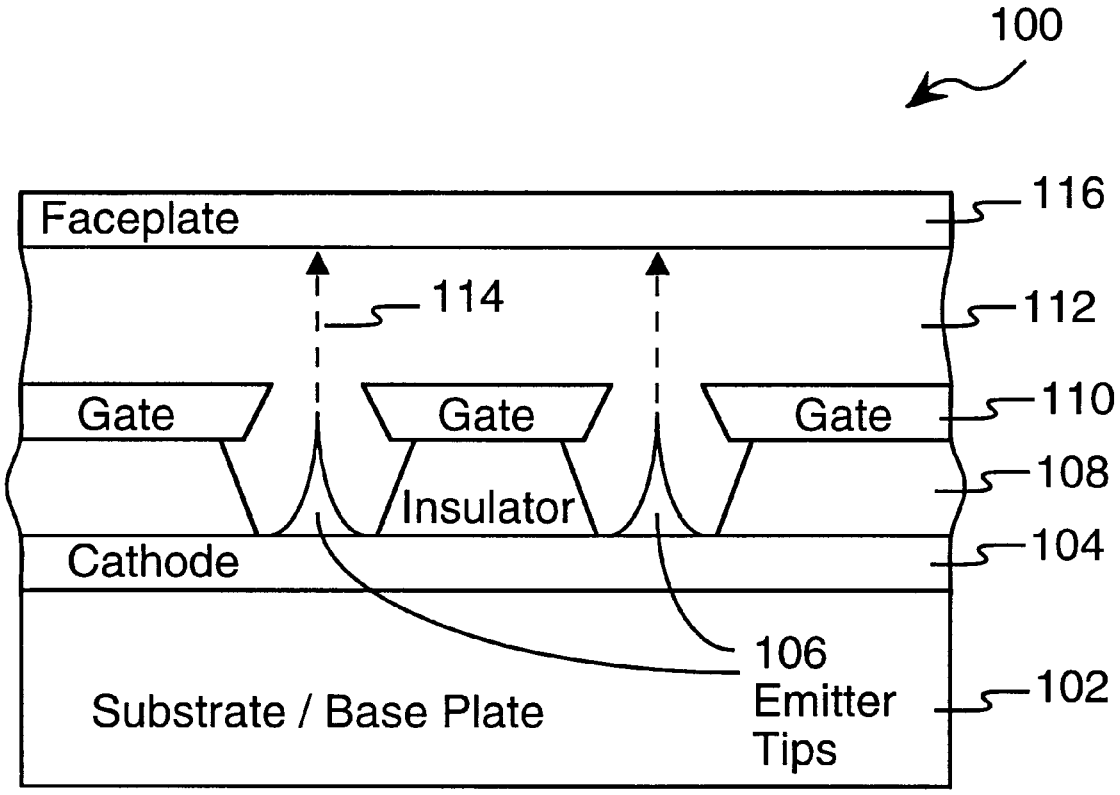
Prior Art FIG. 1
FIG. 1 is a block diagram of an field emission display (FED) device.
Figure 2:
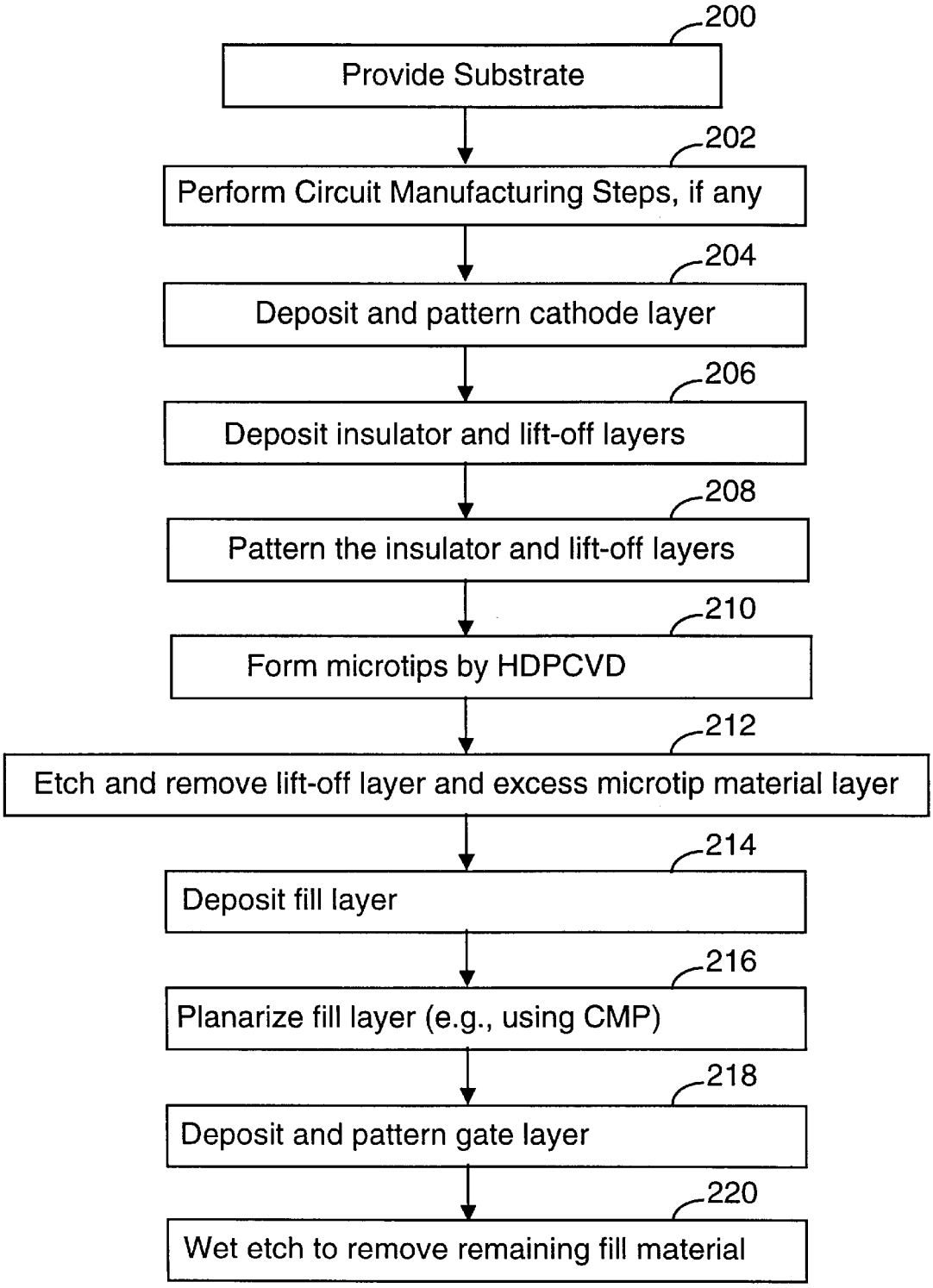
FIG. 2 depicts a flow chart of a preferred embodiment of the field emission tip array manufacturing process.
Figure 3A:
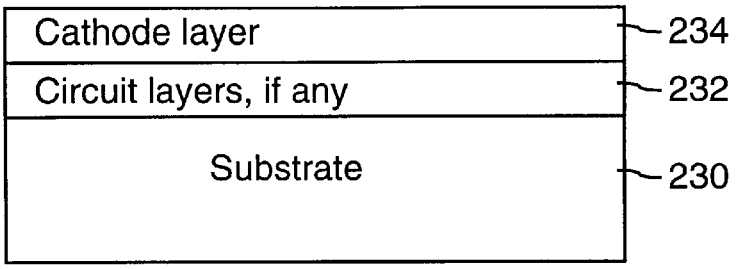
Figure 3B:
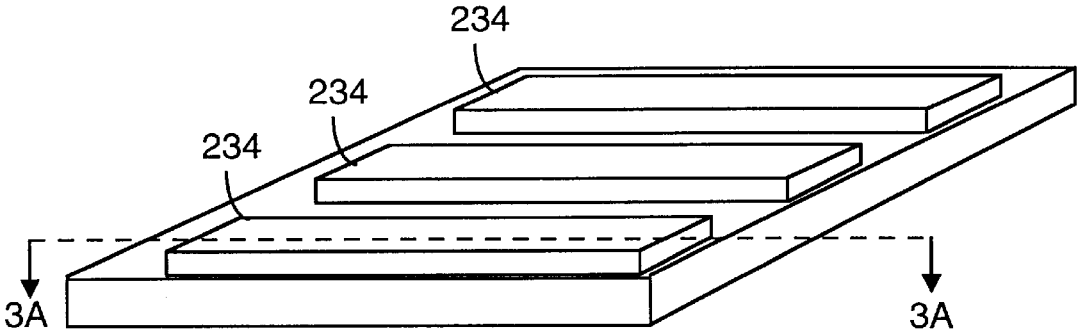
Figure 3C:
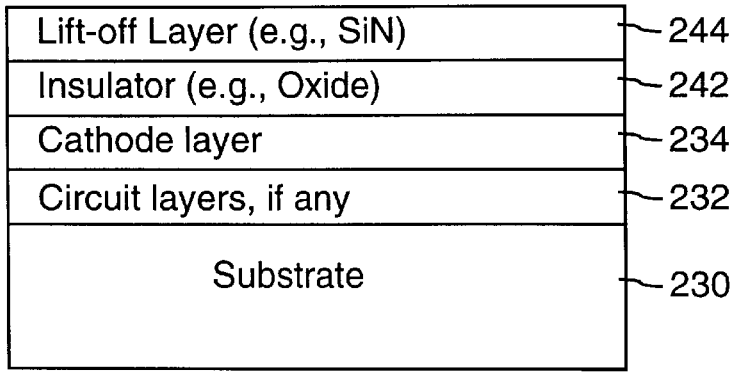

A conductive cathode layer 234 is deposited on top of the substrate 230 (and any circuit layers 232 formed thereon), and patterned to form a set of cathode structures on which the array of field emission tips are to be formed (step 204). For instance, the cathode layer may be patterned to form a set of parallel cathode strips, as shown in FIG. 3B. Optionally, after the layer of cathode material is patterned, a fill layer such as SOG (spin on glass) may be deposited and planarized so as to present a flat profile for the subsequent layers formed on top of the cathode layer.

The phrases "layer X is patterned" and "patterning layer X" are used in this document to mean that layer X is masked and etched so as to form a patterned layer of material.

Figure 3D:
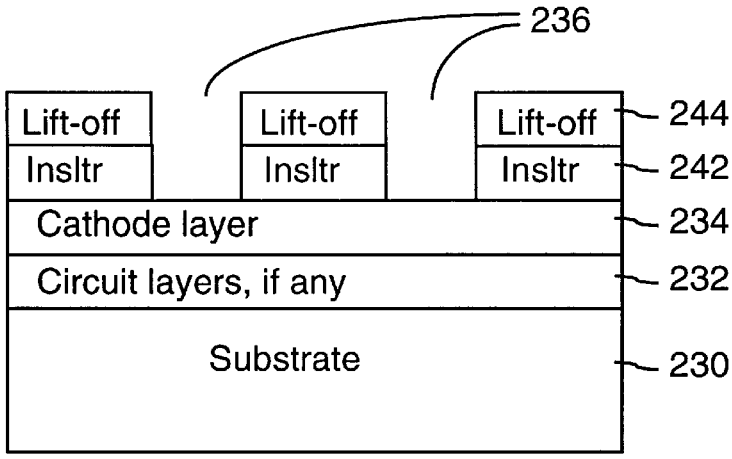

Next (step 206), a layer 242 of insulator material is deposited and then a layer 244 of lift-off material is deposited. The lift-off material should be capable of being selectively etched with respect to the insulator layer and with respect to the tip material. The insulator material layer and lift-off material layers are patterned to define a set of apertures 236 in which tips are to be formed (step 208), as shown in FIG. 3D.

The apertures 236 formed may be between 0.2 and 1.0 micrometers in diameter, and are preferably about 0.35 micrometers in diameter (±20%). The preferred range of tip base size is from 0.4 micrometers to 1.5 micrometers, and is preferably about 0.5 micrometers (±20%).

Figure 3E:
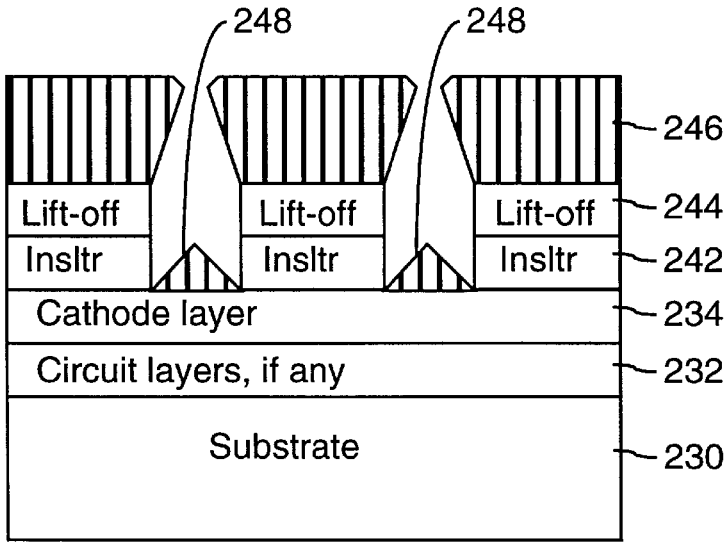
Figure 3F:
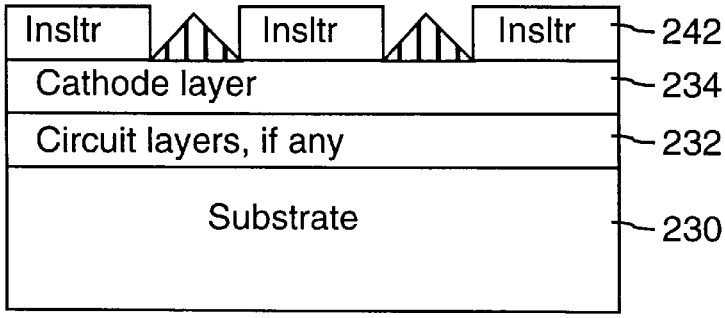
Figure 3F:
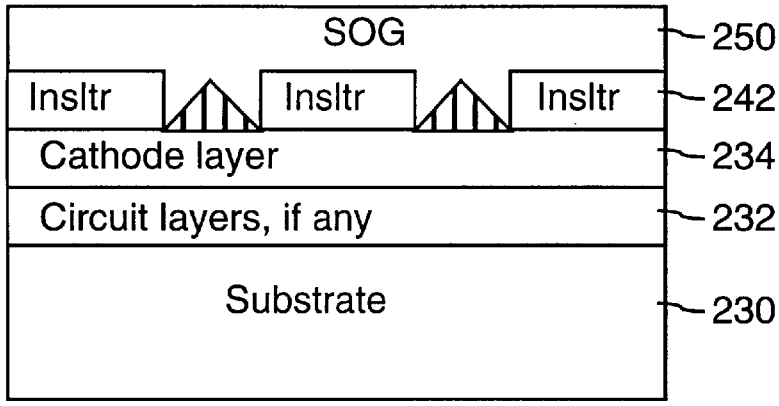
Figure 3G:
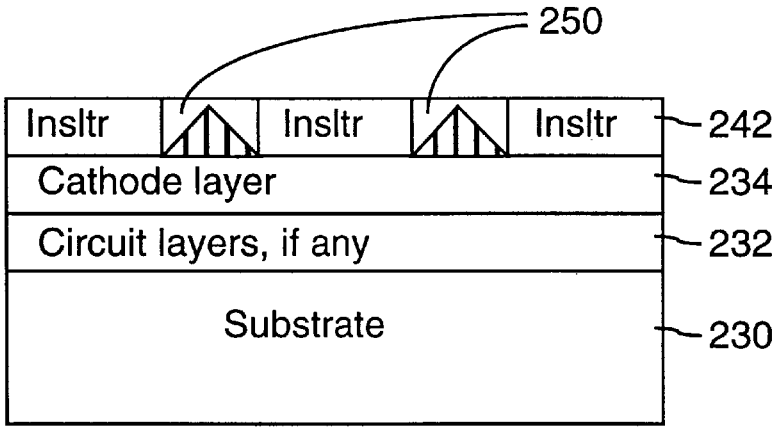
Figure 3H:
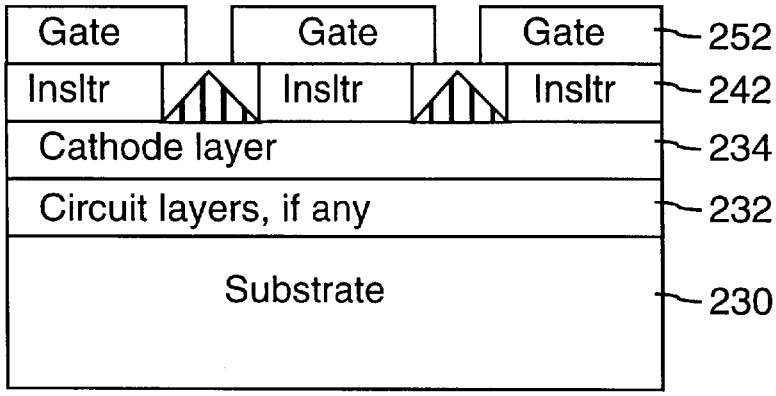

After formation of the apertures 236, the field emission tips (also called microtips) are created by depositing tip material using an unbiased high density plasma chemical vapor deposition (HDPCVD) process to form sharp tips 248 in the apertures 236 (step 210). The HDPCVD process also forms a sacrificial layer 246 (also herein called a set of islands) of the tip material on top of patterned layer 244 of lift-off material, as shown in FIG. 3E. The sacrificial layer 246 at least partially overhangs the apertures, forming a shadow mask during the deposition process which gives rise to a sharp tip profile.

The plasma chemical vapor deposition of the tip material is preferably unbiased, meaning that an RF electric field is not applied to the electrostatic chuck (not shown) supporting the substrate being processed, and thus that a biased RF electrical field is not used to cause ions in the plasma chamber to bombard the substrate. By using an unbiased HDPCVD process, the fill capacity of the deposited tip material is reduced, meaning that HDPCVD process is purposed tuned so as to not completely fill the apertures. This is the opposite of the goal of normal PECVD (plasma enhanced chemical vapor deposition) techniques that are used to completely fill narrow gaps and apertures in semiconductor circuit manufacturing.

After the formation of the tips, the remaining portion of the lift-off layer 244 is removed using a wet chemical etchant that selectively etches the lift-off layer material at a much higher rate than the tip material and the insulator layer material (step 212). The removing step also removes the sacrificial layer 246 of tip material because the sacrificial layer 246 is lifted off the substrate when the underlying lift-off layer 244 is etched away.

In a first preferred embodiment, the insulator material may be silicon dioxide ($SiO_2$), the lift-off material may be silicon nitride (SiN), and the tip material may be doped polysilicon or metal or even a dielectric material such as silicon oxide or silicon nitride. In an embodiment in which the tip material is doped polysilicon, the wet etchant used to remove the lift-off layer 244 is preferably hydrofluoric acid for a silicon oxide lift-off layer or phosphoric acid for a silicon nitride lift-off layer. However, a variety of other materials used in semiconductor manufacturing processes may be used for the insulator layer, lift-off layer and tip material. Generally, the lift-off material must be selectively etchable using a wet etchant that is highly selective with respect to the tip material to be used to form the field emission tips, and is preferably also highly selective with respect to the insulator material.

In a second preferred embodiment, the insulator material may be silicon nitride, the lift-off material may be silicon oxide, and the tip material may be tungsten. In this embodiment, the wet etchant used to remove the lift-off layer 244 is preferably hydrofluoric acid or buffered oxide etch.

After the patterned layer 244 of lift-off material has been removed, a layer 250 of fill material such as spin on glass (SOG) is deposited (step 214) and planarized (step 216) so as to fill the apertures in which the tips are formed (step 214). Planarization of the fill material layer 250 may be achieved using chemical mechanical polishing (CMP), resulting in a top surface that is above the tops of the field emission tips.

If the tip material deposited is a dielectric, the field emission tips may be coated with a thin metal film (to facilitate the emission of electrons), preferably after the removal of the lift-off layer 244 and before the depositing of the fill material 250.

A gate layer 252 is then deposited and patterned to form gate structures (step 218). Additional notches around the tips may be formed in the gate layer (as shown in FIG. 3J) so as to facilitate a subsequent wet etch (step 220) that is used to remove the fill material surrounding the emitter tips.

The HDPCVD process can be performed in a number of commercially available tools, including the DSM 9900 and the EPIC manufactured by LAM Research, the Ultima HDPCVD Centura manufactured by Applied Materials, and the Speedie manufactured by Novellus Systems. Using the Lam Research EPIC, the gap fill process conditions for standard silicon oxide deposition are as follows: microwave power 1400 W, RF power 1400 W, pressure 5 mTorr, silane flow 80 sccm, oxygen flow 160 sccm and argon flow 100 sccm. Under these conditions the gross deposition rate is 7000 Angstroms per minute and the gross sputter etch rate is 2000 Angstroms per minute, resulting in a net deposition rate of 5000 Angstroms per minute. For the formation of oxide tips, the RF power was reduced to 0 W, resulting in a net deposition rate of 7000 Angstroms per minute.

Figure 3I:
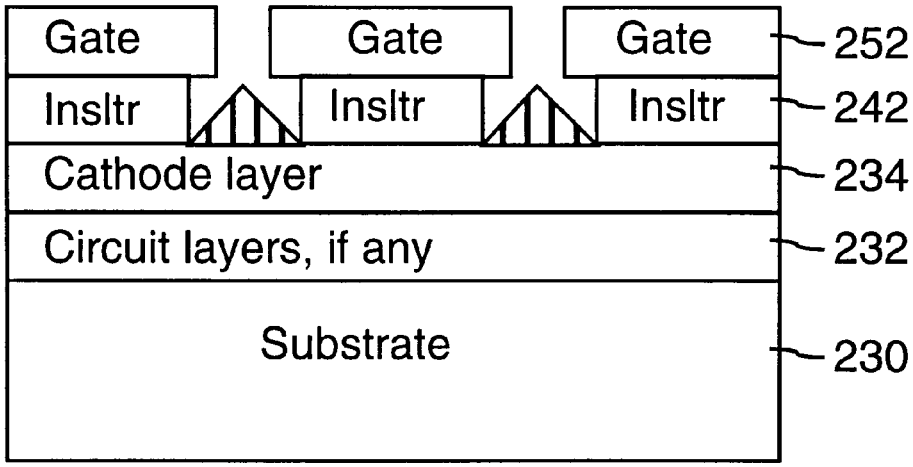
Figure 3J:
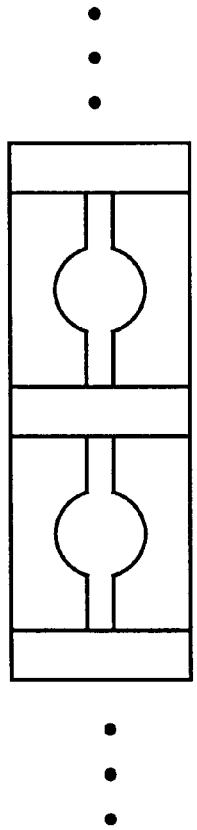

After the formation of the gate structures, the remaining fill material is removed using a wet chemical etchant that selectively etches the fill material at a much higher rate than the tip material, gate material and insulator material (step 220), resulting in the structure shown in FIG. 3I. In a preferred embodiment in which the fill material is FOx (a SOG material manufactured by DOW Corning Company), the insulator material is silicon dioxide ($SiO_2$), the lift-off material is silicon nitride (SiN), and the tip material is doped polysilicon, the etchant used to remove the FOx at step 220 is preferably dilute hydrofluoric acid (100:1 water:HF).

Alternately, only a portion of the fill material in the apertures may be removed. Some of the fill material may be left, so long as the ends of the field emission tips are exposed.

Using the present invention, the inventors have formed field emission tips having a tip radius of less than 1000 angstroms. More specifically, tips having a tip radius of approximately 100 angstroms have been formed.

While the present invention has been described with reference to a few specific embodiments, the description is illustrative of the invention and is not to be construed as limiting the invention. Various modifications may occur to those skilled in the art without departing from the true spirit and scope of the invention as defined by the appended claims.

What is claimed is:

1. A method of manufacturing an array of field emission tips, comprising the steps of:

depositing and patterning a layer of cathode material over a substrate to form a set of cathode structures;

depositing a layer of insulator material and a layer of lift-off material, where the lift-off material is capable of being selectively etched with respect to the insulator material;

patterning the layers of insulator material and lift-off material to define a set of apertures wherever field emission tips are to be formed;

depositing tip material in the apertures and on top of the patterned layer of lift-off material, the tip material deposited in the apertures forming a set of field emission tips, the deposited tip material also forming islands of tip material on top of the patterned layer of lift-off material; and removing the patterned layer of lift-off material using a wet chemical etchant that selectively etches the lift-off material, the removing step also removing the islands of tip material by removing the patterned layer of lift-off material on which the islands of tip material were formed, wherein the removing step does not remove the field emission tips;

further including, subsequent to the removing step:

depositing and planarizing a layer of fill material to fill the apertures in which the tips were formed; and depositing and patterning a gate layer so as to form a set of gate structures.

2. The method of claim 1, further including:

after forming the gate structures, removing at least a portion of the fill material in the apertures.

3. The method of claim 2, the depositing tip material step including using an unbiased high density plasma chemical vapor deposition (HDPCVD) process to form sharp field emission tips in the apertures.

4. The method of claim 3, wherein the insulator material is silicon dioxide, the lift-off layer is silicon nitride and the tip material is a conductive material.

5. The method of claim 4, wherein the tip material is doped polysilicon.

6. The method of claim 3, wherein the removing step is followed by a step of depositing a metal film over the field emission tips.

7. A method of manufacturing an array of field emission tips, comprising the steps of:

depositing and patterning a layer of cathode material over a substrate to form a set of cathode structures;

depositing a layer of insulator material and a layer of lift-off material, where the lift-off material is capable of being selectively etched with respect to the insulator material;

patterning the layers of insulator material and lift-off material to define a set of apertures wherever field emission tips are to be formed;

depositing tip material in the apertures and on top of the patterned layer of lift-off material, the tip material deposited in the apertures forming a set of field emission tips, the deposited tip material also forming islands of tip material on top of the patterned layer of lift-off material; and removing the patterned layer of lift-off material using a wet chemical etchant that selectively etches the lift-off material, the removing step also removing the islands of tip material by removing the patterned layer of lift-off material on which the islands of tip material were formed, wherein the removing step does not remove the field emission tips;

the depositing tip material step including using an unbiased high density plasma chemical vapor deposition (HDPCVD) process to form sharp field emission tips in the apertures.

8. A method of manufacturing an array of field emission tips, comprising the steps of:

depositing and patterning a layer of cathode material over a substrate to form a set of cathode structures;

depositing a layer of insulator material and a layer of lift-off material, where the lift-off material is capable of being selectively etched with respect to the insulator material;

patterning the layers of insulator material and lift-off material to define a set of apertures wherever field emission tips are to be formed;

depositing tip material in the apertures and on top of the patterned layer of lift-off material, the tip material deposited in the apertures forming a set of field emission tips, the deposited tip material also forming islands of tip material on top of the patterned layer of lift-off material; and removing the patterned layer of lift-off material using a wet chemical etchant that selectively etches the lift-off material, the removing step also removing the islands of tip material by removing the patterned layer of lift-off material on which the islands of tip material were formed, wherein the removing step does not remove the field emission tips;

wherein the insulator material is silicon dioxide, the lift-off layer is silicon nitride and the tip material is a conductive material.

9. The method of claim 8, wherein the tip material is doped polysilicon.

10. The method of claim 8, wherein the removing step is followed by a step of depositing a metal film over the field emission tips.

* * * * *